US005801106A

United States Patent [19]

Jameson

[11] Patent Number: 5,801,106

[45] Date of Patent: Sep. 1, 1998

[54] POLYMERIC STRANDS WITH HIGH SURFACE AREA OR ALTERED SURFACE PROPERTIES

[75] Inventor: Lee Kirby Jameson, Roswell, Ga.

[73] Assignee: Kimberly-Clark Worldwide, Inc., Neenah, Wis.

[21] Appl. No.: 644,511

[22] Filed: May 10, 1996

[51] Int. Cl.[6] ..... B32B 3/00

[52] U.S. Cl. ..... 442/334; 428/409; 428/400

[58] Field of Search ..... 442/334; 428/409, 428/400

[56] References Cited

U.S. PATENT DOCUMENTS

| | | | |
|---|---|---|---|
| 2,484,012 | 10/1949 | Calhoun, Jr. | 18/54 |
| 2,484,014 | 10/1949 | Peterson et al. | 18/54 |
| 2,745,136 | 5/1956 | Debouteville | 18/8 |
| 3,016,599 | 1/1962 | Perry, Jr. | 28/78 |
| 3,042,481 | 7/1962 | Coggeshall | 18/54 |
| 3,071,809 | 1/1963 | Lerch et al. | 18/13 |
| 3,194,855 | 7/1965 | Jones et al. | 264/70 |
| 3,203,215 | 8/1965 | Jones | 72/253 |
| 3,233,012 | 2/1966 | Bodine | 264/23 |
| 3,285,442 | 11/1966 | Tigner | 264/70 |

(List continued on next page.)

FOREIGN PATENT DOCUMENTS

| | | |
|---|---|---|
| 9006657 | 7/1993 | Czechoslovakia . |
| 36617 | 9/1981 | European Pat. Off. . |
| 202100 | 11/1986 | European Pat. Off. . |
| 202381 | 11/1986 | European Pat. Off. . |
| 202844 | 11/1986 | European Pat. Off. . |
| 235603 | 9/1987 | European Pat. Off. . |
| 251524 | 1/1988 | European Pat. Off. . |
| 300198 | 1/1989 | European Pat. Off. . |
| 303998 | 2/1989 | European Pat. Off. . |
| 495506 | 7/1992 | European Pat. Off. . |
| 0644280 | 3/1995 | European Pat. Off. . |

(List continued on next page.)

OTHER PUBLICATIONS

V.A. Wente, "Superfine Thermoplastic Fibers", *Industrial & Engineering Chemistry*, V. 48, N. 8, Naval Research Laboratory, Washington, D.C., pp. 1342–1346.

Wente, Boone & Fluharty, "Manufacture of Superfine Organic Fibres", Naval Research Laboratory, Washington, D.C., NRL Report 4364 (111437), May 24, 1954.

Buntin & Lohkamp, "Melt Blowing–A One–Step Web Process for New Nonwoven Products", *TAPPI Journal*, V. 56, No. 4, pp. 74–77.

John Wiley & Sons, "Ultrasonics", *Encyclopedia of Chemical Technology*, 3rd Ed., V. 23, pp. 462–479.

Degassing of Liquids, *Physical Principles of Ultrasonic Technology*, V. 1, Plenum Press, 1973, 1973, pp. 381–509.

PCT Counterpart International Search Report mailed Sep. 1, 1987.

*Primary Examiner*—James J. Bell

*Attorney, Agent, or Firm*—J. E. Ruland

[57] ABSTRACT

A melt-extrudable polymeric strand with altered physical properties formed by extruding an emulsion comprising a melt-extrudable polymer and an immiscible component while subjecting the emulsion to ultrasonic energy. In one embodiment, a melt-extrudable polymeric strand has a plurality of fissures in the surface of the strand such that the strand has a B.E.T. surface area to six times the B.E.T. surface area of an otherwise identical strand lacking the plurality of fissures. Desirably, the strand of this embodiment has a B.E.T. surface area of within a range from about 0.10 to about 0.18 $m^2/g$. In a method for making such a strand, the immiscible component of the extrudable emulsion comprises a substance that is an expandable gas upon extrusion. The expandable gas forms the fissures in the strand. According to another aspect, a polymeric strand has a continuous phase which is a melt-extrudable polymer and a disperse phase which is immiscible with the continuous phase. The disperse phase forms discrete pockets of material in the extruded strand and can include a variety of components which alter the physical properties of the strand. Suitable components of the disperse phase include water, aqueous solutions, oils, low melting point metals, and other physical property altering materials.

26 Claims, 4 Drawing Sheets

U.S. PATENT DOCUMENTS

| | | | |
|---|---|---|---|
| 3,341,394 | 9/1967 | Kinney | 161/72 |
| 3,463,321 | 8/1969 | Van Ingen | 210/388 |
| 3,619,429 | 11/1971 | Torigai et al. | 264/23 |
| 3,655,862 | 4/1972 | Dorschner et al. | 264/290 |
| 3,692,618 | 9/1972 | Doschner et al. | 161/72 |
| 3,704,198 | 11/1972 | Prentice | 161/148 |
| 3,705,068 | 12/1972 | Dobo et al. | 156/441 |
| 3,729,139 | 4/1973 | Tysk | 239/102 |
| 3,755,527 | 8/1973 | Keller et al. | 264/210 |
| 3,802,817 | 4/1974 | Matsuki et al. | 425/66 |
| 3,819,116 | 6/1974 | Goodinge et al. | 239/102 |
| 3,849,241 | 11/1974 | Butin et al. | 161/169 |
| 3,853,651 | 12/1974 | Porte | 156/73.6 |
| 3,884,417 | 5/1975 | Sheffield et al. | 239/102 |
| 3,949,938 | 4/1976 | Goodinge | 239/102 |
| 3,977,604 | 8/1976 | Yokoyama et al. | 239/102 |
| 3,978,185 | 8/1976 | Butin et al. | 264/93 |
| 4,013,223 | 3/1977 | Matin | 239/102 |
| 4,038,348 | 7/1977 | Kompanek | 261/36 A |
| 4,064,605 | 12/1977 | Akiyama et al. | 28/103 |
| 4,067,496 | 1/1978 | Martin | 239/102 |
| 4,091,140 | 5/1978 | Harmon | 428/288 |
| 4,100,319 | 7/1978 | Schwartz | 428/171 |
| 4,100,324 | 7/1978 | Anderson et al. | 428/288 |
| 4,100,798 | 7/1978 | Nilsson et al. | 73/194 E |
| 4,105,004 | 8/1978 | Asai et al. | 123/141 |
| 4,118,531 | 10/1978 | Hauser | 428/224 |
| 4,121,549 | 10/1978 | Martin et al. | 123/32 EA |
| 4,127,087 | 11/1978 | Caves | 123/32 EA |
| 4,127,624 | 11/1978 | Keller et al. | 264/23 |
| 4,134,931 | 1/1979 | Hayes, Jr. et al. | 260/897 |
| 4,198,461 | 4/1980 | Keller et al. | 428/288 |
| 4,239,720 | 12/1980 | Gerlach et al. | 264/147 |
| 4,340,563 | 7/1982 | Appel et al. | 264/518 |
| 4,372,491 | 2/1983 | Fishgal | 239/102 |
| 4,389,999 | 6/1983 | Jaqua | 123/536 |
| 4,405,297 | 9/1983 | Appel et al. | 425/72 |
| 4,418,672 | 12/1983 | Muller et al. | 123/478 |
| 4,434,204 | 2/1984 | Hartman et al. | 428/198 |
| 4,466,571 | 8/1984 | Muhlbauer | 239/101 |
| 4,496,101 | 1/1985 | Northman | 239/102 |
| 4,500,280 | 2/1985 | Astier et al. | 425/569 |
| 4,526,733 | 7/1985 | Lau | 264/12 |
| 4,563,993 | 1/1986 | Yamanchi et al. | 123/478 |
| 4,576,136 | 3/1986 | Yamanchi et al. | 123/590 |
| 4,590,915 | 5/1986 | Yamanchi et al. | 123/590 |
| 4,627,811 | 12/1986 | Greiser et al. | 425/72 |
| 4,644,045 | 2/1987 | Fowells | 526/348 |
| 4,663,220 | 5/1987 | Wisneski et al. | 428/221 |
| 4,665,877 | 5/1987 | Manaka et al. | 123/472 |
| 4,715,353 | 12/1987 | Koike et al. | 123/590 |
| 4,716,879 | 1/1988 | Takayama et al. | 123/590 |
| 4,726,522 | 2/1988 | Kokubo et al. | 239/102.2 |
| 4,726,523 | 2/1988 | Kokubo et al. | 239/102.2 |
| 4,726,524 | 2/1988 | Ishikawa et al. | 239/102.2 |
| 4,726,525 | 2/1988 | Yonekawa et al. | 239/102.2 |
| 4,742,810 | 5/1988 | Anders et al. | 123/538 |
| 4,756,478 | 7/1988 | Endo et al. | 239/102.2 |
| 4,793,954 | 12/1988 | Lee et al. | 264/23 |
| 4,815,192 | 3/1989 | Usui et al. | 29/509 |
| 4,974,780 | 12/1990 | Nakamura et al. | 239/102.2 |
| 4,986,248 | 1/1991 | Kobayaski et al. | 123/590 |
| 4,995,367 | 2/1991 | Yamauchi et al. | 123/494 |
| 5,017,311 | 5/1991 | Furusawa et al. | 264/23 |
| 5,068,068 | 11/1991 | Furusawa et al. | 264/23 |
| 5,110,286 | 5/1992 | Gaysert et al. | 431/208 |
| 5,112,206 | 5/1992 | Stewart | 425/114 |
| 5,114,633 | 5/1992 | Stewart | 264/23 |
| 5,160,746 | 11/1992 | Dodge, II et al. | 425/7 |
| 5,169,067 | 12/1992 | Matsusaka et al. | 239/102.2 |
| 5,179,923 | 1/1993 | Tsurutani et al. | 123/435 |
| 5,226,364 | 7/1993 | Fadner | 101/366 |
| 5,269,981 | 12/1993 | Jameson et al. | 264/123 |
| 5,330,100 | 7/1994 | Malinowski | 239/102.2 |
| 5,382,400 | 1/1995 | Pike et al. | 264/168 |

FOREIGN PATENT DOCUMENTS

| | | |
|---|---|---|
| 2555839 | 6/1976 | Germany . |
| 2734818 | 8/1976 | Germany . |
| 134052 | 2/1979 | Germany . |
| 177045 | 2/1979 | Germany . |
| 138523 | 11/1979 | Germany . |
| 3010985 | 10/1981 | Germany . |
| 3912524 | 11/1989 | Germany . |
| 49-133613 | 12/1974 | Japan . |
| 56-144214 | 11/1981 | Japan . |
| 57-51441 | 3/1982 | Japan . |
| 57-078967 | 5/1982 | Japan . |
| 57-099327 | 9/1982 | Japan . |
| 62-160110 | 7/1987 | Japan . |
| 386977 | 5/1972 | U.S.S.R. . |
| 468948 | 7/1975 | U.S.S.R. . |
| 449504 | 10/1975 | U.S.S.R. . |
| 532529 | 5/1977 | U.S.S.R. . |
| 706250 | 12/1979 | U.S.S.R. . |
| 1479464 | 5/1989 | U.S.S.R. . |
| 1812332 | 4/1993 | U.S.S.R. . |
| 865707 | 4/1961 | United Kingdom . |
| 1382828 | 2/1975 | United Kingdom . |
| 1415539 | 11/1975 | United Kingdom . |
| 1432760 | 4/1976 | United Kingdom . |
| 1555766 | 11/1979 | United Kingdom . |
| 2077351 | 12/1981 | United Kingdom . |
| 2082251 | 3/1982 | United Kingdom . |
| 2274877 | 8/1994 | United Kingdom . |
| 9301404 | 1/1993 | WIPO . |
| 96/00318 A | 1/1996 | WIPO . |

POLYMERIC STRANDS WITH HIGH SURFACE AREA OR ALTERED SURFACE PROPERTIES

TECHNICAL FIELD

This invention relates to polymeric strands made by melt-extruding an emulsion comprising a melt-extrudable polymer as a continuous phase and an immiscible component as a discontinuous phase for altering the physical properties of the strand.

BACKGROUND OF THE INVENTION

The melt-extrusion of liquids, such as, for example, thermoplastic polymers, to form fibers and nonwoven webs generally involves forcing a molten polymer through a plurality of orifices to form a plurality of molten threadlines, contacting the molten threadlines with a fluid, usually air, directed so as to form strands (filaments or fibers) and attenuate them. The attenuated strands then are randomly deposited on a surface to form a nonwoven web.

The more common and well known processes utilized for the preparation of nonwoven webs are meltblowing, coforming, and spunbonding.

Meltblowing references include, by way of example, U.S. Pat. Nos. 3,016,599 to Perry, Jr., 3,704,198 to Prentice, 3,755,527 to Keller et al., 3,849,241 to Butin et al., 3,978,185 to Butin et al., and 4,663,220 to Wisneski et al. See, also, V. A. Wente, "Superfine Thermoplastic Fibers", *Industrial and Engineering Chemistry*, Vol. 48, No. 8, pp. 1342–1346 (1956); V. A. Wente et al., "Manufacture of Superfine Organic Fibers", Navy Research Laboratory, Washington, D.C., NRL Report 4364 (111437), dated May 25, 1954, United States Department of Commerce, Office of Technical Services; and Robert R. Butin and Dwight T. Lohkamp, "Melt Blowing—A One-Step Web Process for New Nonwoven Products", *Journal of the Technical Association of the Pulp and Paper Industry*, Vol. 56, No.4, pp. 74–77 (1973).

Coforming references (i.e., references disclosing a meltblowing process in which fibers or particles are commingled with the meltblown fibers as they are formed) include U.S. Pat. Nos. 4,100,324 to Anderson et al. and 4,118,531 to Hauser.

Finally, spunbonding references include, among others, U.S. Pat. Nos. 3,341,394 to Kinney, 3,655,862 to Dorschner et al., 3,692,618 to Dorschner et al., 3,705,068 to Dobo et al., 3,802,817 to Matsuki et al., 3,853,651 to Porte, 4,064,605 to Akiyama et al., 4,091,140 to Harmon, 4,100,319 to Schwartz, 4,340,563 to Appel and Morman, 4,405,297 to Appel and Morman, 4,434,204 to Hartman et al., 4,627,811 to Greiser and Wagner, and 4,644,045 to Fowells.

Nonwoven webs have many uses including cleaning products such as towels and industrial wipes, personal care items such as incontinence products, infant care products, and absorbent feminine care products, and garments such as medical apparel. These applications require polymeric strands with a wide variety of physical properties. The physical properties of melt-extruded polymeric strands are limited, however, and must often be engineered or surface treated for use in certain applications. For example, many thermoplastic materials used to make polymeric strands and nonwoven materials are hydrophobic and do not attract or wick water very well. To make some thermoplastic strands and resulting nonwoven materials hydrophilic, they must be treated with a material such as a surfactant which is often applied by spraying or dipping the product. Although there are many suitable methods and treatments to affect the physical properties of melt-extruded polymeric strands and nonwoven materials made therewith, there remains a need for a wider variety of physical properties and more economical and effective ways of altering the physical properties of melt-extruded strands and nonwovens.

SUMMARY OF THE INVENTION

This invention addresses some of the needs described above by providing a melt-extruded polymeric strand comprising a melt-extrudable polymer and having a plurality of fissures in the surface of the strand. Desirably, the strand has a B.E.T. surface area within a range from about 0.10 to about 0.18 $m^2g$. This invention also encompasses a method for making such a strand by extruding an emulsion while applying ultrasonic energy to form the emulsion. This invention further encompasses a nonwoven web and a method for making a nonwoven web comprising such a melt-extruded polymeric strand.

More particularly, the melt-extruded polymeric strand of this invention having the plurality of surface fissures also has a mean diameter within the range from about 1 to about 200 micrometers and the fissures are desirably present in an amount from about $1\times10^8$ to about $1\times10^{10}$ per $m^2$. The B.E.T. surface area of such a strand is 2 to 6 times the B.E.T. surface are of an otherwise identical strand lacking the plurality of fissures. Such a high surface polymeric strand more effectively wicks liquid such as water than an otherwise identical strand lacking the plurality of fissures. The same is true of a nonwoven web made with a strand of this invention having the enhanced surface area.

According to an embodiment of this invention, the melt-extruded polymeric strand having the plurality of surface fissures may also include an immiscible component which is present at the surface of the strand at the fissures. The immiscible component is immiscible with the melt-extrudable polymer when the melt-extrudable polymer and the immiscible component are at a temperature suitable for melt-extrusion of the polymer. The immiscible component desirably performs a function at the surface of the strand not performed by the melt-extrudable polymer. For example, the immiscible component can comprise a hydrophilic polymer while the melt-extrudable polymer is hydrophobic. Other exemplary immiscible components include surfactants, odorants and starches.

The polymeric strand of this invention having the plurality of fissures in the strand surface is made by applying ultrasonic energy to a portion of a multicomponent liquid to form an emulsion and extruding the emulsion. More particularly, the method includes extruding a multi-component pressurized liquid through a die assembly, applying ultrasonic energy to a portion of the multi-component liquid, and attenuating the extruded multi-component liquid to form a strand. The die assembly includes a die housing and a device for applying ultrasonic energy to the multi-component liquid. The die housing comprises a chamber adapted to receive the pressurized multi-component liquid, an inlet adapted to supply the chamber with the pressurized multi-component liquid, and an exit orifice defined by the walls of a die tip. The exit orifice is adapted to receive the pressurized multi-component liquid from the chamber and pass the multi-component liquid out of the die housing.

The multi-component pressurized liquid comprises a melt-extrudable polymer and an immiscible component which is immiscible in the melt-extrudable polymer when the multi-component pressurized liquid is at a temperature suitable for melt-extrusion and is capable of forming an expanding gas after the multi-component pressurized liquid is passed out of the die housing through the exit orifice. The ultrasonic energy is applied to a portion of the pressurized multi-component liquid within the chamber and without applying ultrasonic energy to the die tip, while the exit orifice receives the pressurized multi-component liquid from the die housing chamber. Consequently, the pressurized multi-component liquid passes out of the exit orifice in the die tip as an emulsion. The melt-extrudable polymer forms a continuous phase of the emulsion and the immiscible component forms a disperse phase of the emulsion. Upon extrusion of the multi-component liquid out of the exit orifice in the die tip and during attenuation of the extruded multi-component liquid to form a strand, the immiscible component forms an expanding gas which explodes through the surface of the strand and forms the plurality of fissures in the strand surface.

Desirably, the immiscible component includes water which forms steam during extrusion of the polymer and explodes through the surface of the strand to form the fissures. The immiscible component may also include a functional ingredient such as a hydrophilic polymer, a surfactant, an odorant, or the like, as described above with regard to the melt-extruded polymeric strand.

According to another aspect, this invention further comprehends a melt-extruded polymeric strand comprising a continuous phase which is the melt-extrudable polymer and a disperse phase comprising an amendment for altering the physical properties of the strand. The amendment is immiscible with the continuous phase when the continuous phase and the disperse phase are at a temperature suitable for melt-extrusion of the polymeric strand.

Described more particularly, the melt-extruded polymeric strand of this invention described immediately hereinbefore has a dispersed phase which comprises discreet pockets of material separated by the continuous phase. The disperse phase desirably includes an ingredient which performs a function not performed by the melt-extrudable polymer. For example, the disperse phase may include lubricating oils, skin emollients, tinting oils, waxes, polishing oils, silicones, vegetable oils, glycerines, lanolin, flame retardants, tackifiers, degradation triggers, insecticides, fungicides, bactericides, viricides, colloids, and suspensions. Alternatively, the disperse phase can comprise a gas such as air, or an electroluminescent gas such as neon or argon. According to another embodiment, the disperse phase can comprise a low melting point metal or alloy such as bismuth alloys, indium alloys, tin, or gallium. Such metals should be molten at temperatures suitable for melt-extrusion of the polymeric strand. The foregoing amendments which form the disperse phase of the polymeric strand impart a variety of physical properties to the polymeric strand and allow the polymeric strands to be useful for a variety of end uses.

This invention encompasses a method for making a polymeric strand including the amendments described immediately hereinbefore. The method is very similar to the method described hereinabove with regard to the strand having the plurality of fissures except that the immiscible component of the multi-component liquid does not necessarily include a component for forming an expanding gas.

Nonwoven webs made with the above-described polymeric strands are made by depositing the polymeric strands onto a collecting surface such as in meltblowing, coforming, or spunbonding techniques.

Other objects and the broad scope of the applicability of this invention will become apparent to those of skill in the art from the details given hereinafter. However, it should be understood that the detailed description of the preferred embodiments of the invention is given only by way of illustration because various changes and modifications well within the scope of the invention should become apparent to those of skill in the art in view of the following detailed description.

DETAILED DESCRIPTION OF EMBODIMENTS OF THE INVENTION

Figure 1:
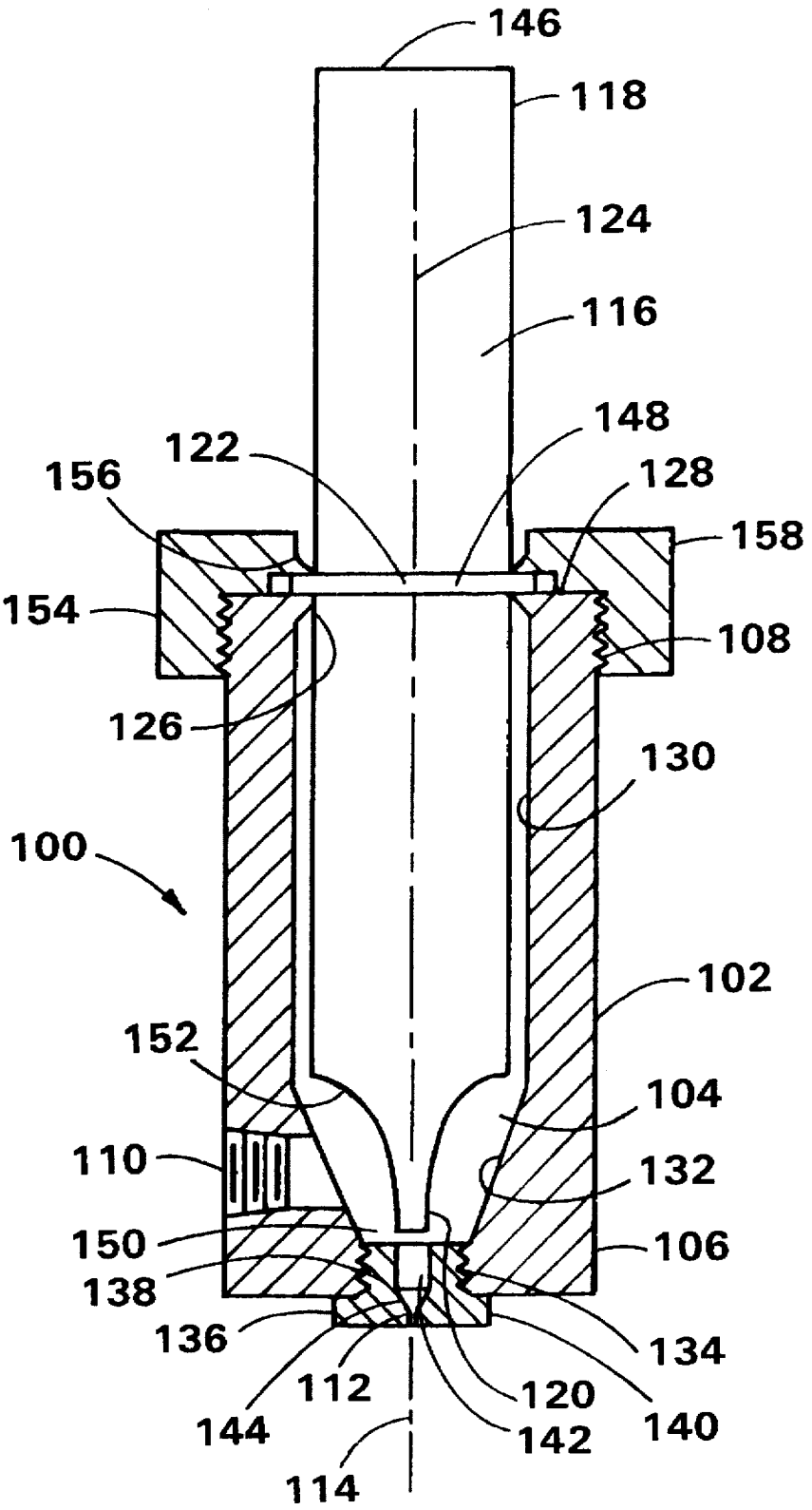
FIG. 1 is a cross-sectional elevation view of an apparatus for making an embodiment of the present invention.

As summarized above, this invention encompasses melt-extruded polymeric strands with altered physical properties, nonwoven webs made with such strands and methods for making the foregoing. After defining certain terms used herein, an apparatus for use in making strands in accordance with an embodiment of this invention is described, followed by a description of methods for using the apparatus and particular examples of polymeric strands made with the apparatus.

As used herein, the term "strand" refers to an elongated extrudate formed by passing a polymer through a forming orifice such as a die. Strands include fibers, which are discontinuous strands having a definite length, and filaments, which are continuous strands of material.

As used herein, the term "nonwoven web" means a web of material which has been formed without use of weaving processes which produce a structure of individual strands which are interwoven in an identifiable repeating manner. Nonwoven webs may be formed by a variety of processes such as meltblowing processes, spunbonding processes, film aperturing processes, coforming processes, and staple fiber carding processes.

As used herein, the term "liquid" refers to an amorphous (noncrystalline) form of matter intermediate between gases and solids, in which the molecules are much more highly concentrated than in gases, but much less concentrated than in solids. A liquid may have a single component or may be made of multiple components. The components may be other liquids, solids and/or gases. For example, characteristic of liquids is their ability to flow as a result of an applied force. Liquids that flow immediately upon application of force and for which the rate of flow is directly proportional to the force applied are generally referred to as Newtonian liquids. Some liquids have abnormal flow response when force is applied and exhibit non-Newtonian flow properties.

As used herein, the terms "thermoplastic polymer" and "thermoplastic material" refer to a high polymer that softens when exposed to heat and returns to its original condition when cooled to room temperature. The terms are meant to include any thermoplastic polymer which is capable of being melt-extruded. The term also is meant to include blends of two or more polymers and alternating, random, and block copolymers. Examples of thermoplastic polymers include, by way of illustration only, end-capped polyacetals, such as poly(oxymethylene) or polyformaldehyde, poly (trichloroacetaldehyde), poly(n-valeraldehyde), poly (acetaldehyde), poly(propionaldehyde), and the like; acrylic polymers, such as polyacrylamide, poly(acrylic acid), poly (methacrylic acid), poly(ethyl acrylate), poly(methyl methacrylate), and the like; fluorocarbon polymers, such as poly(tetrafluoroethylene), perfluorinated ethylene-propylene copolymers, ethylene-tetrafluoroethylene copolymers, poly (chlorotrifluoroethylene), ethylene-chlorotrifluoroethylene copolymers, poly(vinylidene fluoride), poly(vinyl fluoride), and the like; polyamides, such as poly(6-aminocaproic acid) or poly(caprolactam), poly(hexamethylene adipamide), poly (hexamethylene sebacamide), poly(11-aminoundecanoic acid), and the like; polyaramides, such as poly(imino-1,3-phenyleneiminoisophthaloyl) or poly(m-phenylene isophthalamide), and the like; parylenes, such as poly-p-xylylene, poly(chloro-p-xylylene), and the like; polyaryl ethers, such as poly(oxy-2,6-dimethyl-1,4-phenylene) or poly(p-phenylene oxide), and the like; polyaryl sulfones, such as poly(oxy-1,4-phenylenesulfonyl-1,4-phenyleneoxy-1,4-phenyleneisopropylidene-1,4-phenylene), poly (sulfonyl-1,4-phenyleneoxy-1,4-phenylenesulfonyl-4,4'-biphenylene), and the like; polycarbonates, such as poly (bisphenol A) or poly(carbonyldioxy-1,4-phenyleneisopropylidene-1,4-phenylene), and the like; polyesters, such as poly(ethylene terephthalate), poly (tetramethylene terephthalate), poly(cyclohexylene-1,4-dimethylene terephthalate) or poly(oxymethylene-1,4-cyclohexylenemethyleneoxyterephthaloyl), and the like; polyaryl sulfides, such as poly(p-phenylene sulfide) or poly (thio-1,4-phenylene), and the like; polyimides, such as poly (pyromellitimido-1,4-phenylene), and the like; polyolefins, such as polyethylene, polypropylene, poly(1-butene), poly (2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly (vinylidene chloride), polystyrene, and the like; copolymers of the foregoing, such as acrylonitrile-butadiene-styrene (ABS) copolymers, and the like; and the like.

By way of example, the thermoplastic polymer may be a polyolefin, examples of which are listed above. As a further example, the thermoplastic polymer may be a polyolefin which contains only hydrogen and carbon atoms and which is prepared by the addition polymerization of one or more unsaturated monomers. Examples of such polyolefins include, among others, polyethylene, polypropylene, poly (1-butene), poly(2-butene), poly(1-pentene), poly(2-pentene), poly(3-methyl-1-pentene), poly(4-methyl-1-pentene), 1,2-poly1,3-butadiene, 1,4-poly-1,3-butadiene, polyisoprene, polystyrene, and the like, as well as blends of two or more such polyolefins and alternating, random, and block copolymers prepared from two or more different unsaturated monomers.

As used herein, the term "hydrophilic", when describing polymers, means a polymer having a surface energy at 20° C. within the range of about 55 to about 75 dynes/cm$^2$. In addition, as used herein, the term "hydrophobic" with regard to polymers, means a polymer having a surface energy of 20° C. within the range of about 20 dynes/cm$^2$ to about 50 dynes/cm$^2$.

As used herein, the term "emulsion" refers to a relatively stable mixture of two or more immiscible liquids that, in some cases, may be held in suspension by small percentages of substances called emulsifiers or stabilizers. Emulsions may also be held in suspension or stabilized by the continuous phase being extremely viscous, or by the solidification of the continuous phase after the formation of the emulsion. Emulsions are composed of a continuous phase and a disperse phase. For example, in an oil in water emulsion, water is the continuous phase and oil is the disperse phase.

As used herein, the term "node" means the point on the longitudinal excitation axis of the ultrasonic horn at which no longitudinal motion of the horn occurs upon excitation by ultrasonic energy. The node sometimes is referred to in the art, as well as in this specification, as the nodal point.

The term "close proximity" is used herein in a qualitative sense only. That is, the term is used to mean that the means for applying ultrasonic energy is sufficiently close to the exit orifice (e.g., extrusion orifice) to apply the ultrasonic energy primarily to the liquid (e.g., multi-component liquid) passing into the exit orifice (e.g., extrusion orifice). The term is not used in the sense of defining specific distances from the extrusion orifice.

Generally speaking, the apparatus of the present invention includes a die housing and a means for applying ultrasonic energy to a portion of a pressurized multi-component liquid such as a molten thermoplastic polymer and water. The die housing defines a chamber adapted to receive the pressurized multi-component liquid, an inlet (e.g., inlet orifice) adapted to supply the chamber with the pressurized multi-component liquid, and an exit orifice (e.g., extrusion orifice) adapted to receive the pressurized liquid from the chamber and pass the liquid out of the exit orifice of the die housing so that the multi-component liquid is emulsified. The means for applying ultrasonic energy is located within the chamber. For example, the means for applying ultrasonic energy can be located partially within the chamber or the means for applying ultrasonic energy can be located entirely within the chamber.

Referring now to FIG. 1, there is shown, not necessarily to scale, an exemplary apparatus for emulsifying a pressurized multi-component liquid. The apparatus 100 includes a die housing 102 which defines a chamber 104 adapted to receive a pressurized multi-component liquid such as molten thermoplastic polymer. The die housing 102 has a first end 106 and a second end 108. The die housing 102 also has an inlet 110 (e.g., inlet orifice) adapted to supply the chamber 104 with the pressurized multi-component liquid. An exit orifice 112 (which may also be referred to as an extrusion orifice) is located in the first end 106 of the die housing 102; it is adapted to receive the pressurized multi-component liquid from the chamber 104 and pass the multi-component liquid out of the die housing 102 along a first axis 114. An ultrasonic horn 116 is located in the second end 108 of the die housing 102. The ultrasonic horn has a first end 118 and a second end 120. The horn 116 is located in the second end 108 of the die housing 102 in a manner such that the first end 118 of the horn 116 is located outside of the die housing 102 and the second end 120 of the horn 116 is located inside the die housing 102, within the chamber 104, and is in close proximity to the exit orifice 112. The horn 116 is adapted, upon excitation by ultrasonic energy, to have a nodal point 122 and a longitudinal mechanical excitation axis 124. Desirably, the first axis 114 and the mechanical excitation axis 124 will be substantially parallel. More desirably, the first axis 114 and the mechanical excitation axis 124 will substantially coincide, as shown in FIG. 1.

The apparatus 10*n* shown in FIG. 1 is disclosed in U.S. application Ser. No. 08/576,543 entitled "An Apparatus And Method For Emulsifying A Pressurized Multi-Component Liquid", in the name of L. K. Jameson et al., the subject matter of which application is hereby incorporated by reference in its entirety.

The size and shape of the apparatus of the present invention can vary widely, depending, at least in part, on the number and arrangement of exit orifices (e.g., extrusion orifices) and the operating frequency of the means for applying ultrasonic energy. For example, the die housing may be cylindrical, rectangular, or any other shape. Moreover, the die housing may have a single exit orifice or a plurality of exit orifices. A plurality of exit orifices may be arranged in a pattern, including but not limited to, a linear or a circular pattern.

The means for applying ultrasonic energy is located within the chamber, typically at least partially surrounded by the pressurized liquid. Such means is adapted to apply the ultrasonic energy to the pressurized liquid as it passes into the exit orifice. Stated differently, such means is adapted to apply ultrasonic energy to a portion of the pressurized liquid in the vicinity of each exit orifice. Such means may be located completely or partially within the chamber.

When the means for applying ultrasonic energy is an ultrasonic horn, the horn conveniently extends through the die housing, such as through the first end of the housing as identified in FIG. 1. However, the present invention comprehends other configurations. For example, the horn may extend through a wall of the die housing, rather than through an end. Moreover, neither the first axis nor the longitudinal excitation axis of the horn need to be vertical. If desired, the longitudinal mechanical excitation axis of the horn may be at an angle to the first axis. Nevertheless, the longitudinal mechanical excitation axis of the ultrasonic horn desirably will be substantially parallel with the first axis. More desirably, the longitudinal mechanical excitation axis of the ultrasonic horn desirably and the first axis will substantially coincide, as shown in FIG. 1.

If desired, more than one means for applying ultrasonic energy may be located within the chamber defined by the die housing. Moreover, a single means may apply ultrasonic energy to the portion of the pressurized liquid which is in the vicinity of one or more exit orifices.

According to the present invention, the ultrasonic horn may be composed of a magnetostrictive material. The horn may be surrounded by a coil (which may be immersed in the liquid) capable of inducing a signal into the magnetostrictive material causing it to vibrate at ultrasonic frequencies. In such cases, the ultrasonic horn can simultaneously be the transducer and the means for applying ultrasonic energy to the multi-component liquid.

The application of ultrasonic energy to a plurality of exit orifices, such as in a meltblowing or spunbonding apparatus, may be accomplished by a variety of methods. For example, with reference again to the use of an ultrasonic horn, the second end of the horn may have a cross-sectional area which is sufficiently large so as to apply ultrasonic energy to the portion of the pressurized multi-component liquid which is in the vicinity of all of the exit orifices in the die housing. In such case, the second end of the ultrasonic horn desirably will have a cross-sectional area approximately the same as or greater than a minimum area which encompasses all exit orifices in the die housing (i.e., a minimum area which is the same as or greater than the sum of the areas of the exit orifices in the die housing originating in the same chamber). Alternatively, the second end of the horn may have a plurality of protrusions, or tips, equal in number to the number of exit orifices. In this instance, the cross-sectional area of each protrusion or tip desirably will be approximately the same as or less than the cross-sectional area of the exit orifice with which the protrusion or tip is in close proximity.

The planar relationship between the second end of the ultrasonic horn and an array of exit orifices may also be shaped (e.g., parabolically, hemispherically, or provided with a shallow curvature) to provide or correct for certain spray patterns.

As already noted, the term "close proximity" is used herein to mean that the means for applying ultrasonic energy is sufficiently close to the exit orifice to apply the ultrasonic energy primarily to the pressurized multi-component liquid passing into the exit orifice. The actual distance of the means for applying ultrasonic energy from the exit orifice in any given situation will depend upon a number of factors, some of which are the flow rate of the pressurized multi-component liquid (e.g., the flow rate, rheological characteristics or the viscosity of a liquid), the cross-sectional area of the end of the means for applying the ultrasonic energy relative to the cross-sectional area of the exit orifice, the frequency of the ultrasonic energy, the gain of the means for applying the ultrasonic energy (e.g., the magnitude of the longitudinal mechanical excitation of the means for applying ultrasonic energy), the temperature of the pressurized multi-component liquid, the particular emulsification properties of the liquids, the rheological characteristics of the emulsion, and the rate at which the multi-component liquid (i.e., the emulsion) passes out of the exit orifice.

In general, the distance of the means for applying ultrasonic energy from the exit orifice in a given situation may be determined readily by one having ordinary skill in the art without undue experimentation. In practice, such distance will be in the range of from about 0.002 inch (about 0.05 mm) to about 1.3 inches (about 33 mm), although greater distances can be employed. Such distance determines the extent to which ultrasonic energy is applied to the pressurized multi-component liquid other than that which is about to enter the exit orifice; i.e., the greater the distance, the greater the amount of pressurized liquid which is subjected to ultrasonic energy. Consequently, shorter distances generally are desired in order to minimize degradation of the pressurized multi-component liquid and other adverse effects which may result from exposure of the multi-component liquid to the ultrasonic energy. Desirably, the means for applying ultrasonic energy is an immersed ultrasonic horn having a longitudinal mechanical excitation axis and in which the end of the horn located in the die housing nearest the orifice is in close proximity to the exit orifice but does not apply ultrasonic energy directly to the exit orifice.

One advantage of the foregoing apparatus is that it is self-cleaning. That is, the combination of supplied pressure and forces generated by ultrasonically exciting the means for supplying ultrasonic energy to the pressurized liquid (without applying ultrasonic energy directly to the orifice) can remove obstructions that appear to block the exit orifice (e.g., extrusion orifice). According to the invention, the exit orifice is adapted to be self-cleaning when the means for applying ultrasonic energy is excited with ultrasonic energy (without applying ultrasonic energy directly to the orifice) while the exit orifice receives pressurized multi-component liquid from the chamber and passes the multi-component liquid out of the die housing to form an emulsion.

In general, melt-extruded polymeric strands are formed with the extruder apparatus 100 illustrated in FIG. 1 by introducing a pressurized multi-component liquid into the chamber 104 of the die housing 102 through the inlet 110 and exciting the ultrasonic horn 116 as the pressurized multi-component liquid is extruded through the exit orifice 112. As described above, the multi-component pressurized liquid comprises a melt-extrudable polymer and an immiscible component which is immiscible in the melt-extrudable polymer when the multi-component pressurized liquid is at a temperature suitable for melt-extrusion. The ultrasonic energy applied by the ultrasonic horn 116 applies ultrasonic energy to a portion of the pressurized multi-component liquid within the chamber and without applying ultrasonic energy to the die tip, while the multi-component liquid is received and extruded through the exit orifice 112. The ultrasonic energy emulsifies the multi-component liquid so that the melt-extrudable polymer forms a continuous phase of the emulsion and the immiscible component forms a disperse phase of the emulsion. After the multi-component liquid is extruded through the exit orifice 112, the extruded multi-component liquid is attenuated to form a strand. The attenuation of the extruded multi-component liquid can be accomplished mechanically or by entraining the fiber in a fluid such as in a meltblowing or spunbonding process. To form a nonwoven web from the extruded strand, the strand is randomly deposited on a collecting surface. Nonwoven webs can also be prepared by extruding the multi-component liquid and forming a strand, cutting the strand into staple fibers, and carding the staple fibers into a nonwoven web which can be subsequently bonded by known means.

The physical properties of the resulting melt-extruded polymeric strand depend largely on the melt-extruded polymer which forms a continuous phase and the amendment or immiscible component which forms the disperse phase. Suitable melt-extrudable polymers are described above and a wide variety of amendments can be combined with the melt-extrudable polymer. For example, a high surface area strand can be produced by combining water, as the immiscible component, with a non-water soluble, melt-extrudable polymer as the continuous phase. When the mixture of melt-extrudable polymer and water is emulsified in the extruder apparatus chamber 104, the melt-extrudable polymer forms the continuous phase of the emulsion and the water forms the disperse phase of the emulsion. When the melt-extrudable polymer/water emulsion is extruded and attenuated to form a strand, the water forms steam which expands and explodes through the surface of the strand and forms a plurality of fissures in the strand surface. These fissures increase the surface area of the strand and cause the strand to be more effective in wicking liquid such as water.

The polymeric strand formed with the melt-extrudable polymer and water can have a plurality of fissures in the surface of the strand such that the strand has a B.E.T. surface area which is 2 to 6 times the B.E.T. surface area of an otherwise identical strand lacking the plurality of fissures. More particularly, the fissures can create a B.E.T. surface area within a range from about 0.10 to about 0.18 $m^2/g$. In a desirable embodiment, such a melt-extruded high surface area polymeric strand has a mean diameter within the range from about 1 to about 200 micrometers and has fissures present in an amount from about $1\times10^8$ to about $1\times10^{10}$ per $m^2$.

In another desirable embodiment of the invention, the melt-extruded polymeric strand is formed with an aqueous solution containing water and a component which performs a function at the surface of the strand not performed by the melt-extrudable polymer. For example, the melt-extrudable polymer can be a hydrophobic polymer such as polyproylene and the immiscible component can comprise an aqueous solution of a hydrophilic polymer such as polyvinyl alcohol. The resulting polymeric strand has a plurality of fissures in the surface of the strand and polyvinyl alcohol is present at the surface of the strand at the fissures. The hydrophilic polyvinyl alcohol improves the wettability of the polymeric strand and the ability of the strand to wick fluid such as water.

Other suitable aqueous solutions for use as the immiscible component or disperse phase in making polymeric strands of this invention include other aqueous polymers, surfactants, odorants, starches, anti-fouling agents, salts, and other functional chemical compounds.

According to another embodiment of the invention, the immiscible component or disperse phase of the multi-component liquid can include a low melting point metal or alloy. By low melting, it is meant that the metal or alloy is molten at melt-extrusion temperatures for the multi-component liquid. Suitable low melting point metals and alloys include tin, gallium, bismuth alloys, and indium alloys.

According to still other embodiments of the invention, the immiscible component or disperse phase of the multi-component liquid can include a variety of oils, oil based materials, and other non-phase change liquids such as lubricating oils, skin emollients, tinting oils, including fluorescent and luminescent oils, waxes, polishing oils, silicones, vegetable oils, glycerin, lanolin, flame retardants, tackifiers, degradation triggers such as time, photo, or chemical environment sensitive degradation triggers, insecticides, fungicides, bactericides, viricides, colloids and suspensions, and emulsion reaction catalysts.

According to yet additional embodiments of the invention, the immiscible component or disperse phase of the multi-component liquid can include gases such as air or electroluminescent gases such as neon and argon. The resulting strands can have relatively light density, opacity, increase surface area, or electroluminescence.

When the immiscible component or disperse phase of the multi-component liquid includes a substance which forms an expanding gas upon extrusion of the multi-component liquid, the immiscible component is initially entrapped in the melt-extrudable polymer during melt-extrusion and then explodes through the surface of the strand to form fissures in the strand. When the immiscible component or the disperse phase of the multi-component liquid does not include a substance that forms such an expanding gas, the disperse phase forms pockets of the immiscible component and the resulting strand includes the pockets of this disperse phase entrapped in the continuous melt-extrudable polymer phase.

The present invention is further described by the examples which follow. Such examples, however, are not to be construed as limiting in any way either the spirit or the scope of the present invention.

EXAMPLES

Ultrasonic Horn Apparatus

The following is a description of an exemplary ultrasonic horn apparatus of the present invention generally as shown in FIG. 1.

With reference to FIG. 1, the die housing 102 of the apparatus was a cylinder having an outer diameter of 1.375 inches (about 34.9 mm), an inner diameter of 0.875 inch (about 22.2 mm), and a length of 3.086 inches (about 78.4 mm). The outer 0.312-inch (about 7.9-mm) portion of the second end 108 of the die housing was threaded with 16-pitch threads. The inside of the second end had a beveled edge 126, or chamfer, extending from the face 128 of the second end toward the first end 106 a distance of 0.125 inch (about 3.2 mm). The chamfer reduced the inner diameter of the die housing at the face of the second end to 0.75 inch (about 19.0 mm). An inlet 110 (also called an inlet orifice) was drilled in the die housing, the center of which was 0.688 inch (about 17.5 mm) from the first end, and tapped. The inner wall of the die housing consisted of a cylindrical portion 130 and a conical frustrum portion 132. The cylindrical portion extended from the chamfer at the second end toward the first end to within 0.992 inch (about 25.2 mm) from the face of the first end. The conical frustrum portion extended from the cylindrical portion a distance of 0.625 inch (about 15.9 mm), terminating at a threaded opening 134 in the first end. The diameter of the threaded opening was 0.375 inch (about 9.5 mm); such opening was 0.367 inch (about 9.3 mm) in length.

A die tip 136 was located in the threaded opening of the first end. The die tip consisted of a threaded cylinder 138 having a circular shoulder portion 140. The shoulder portion was 0.125 inch (about 3.2 mm) thick and had two parallel faces (not shown) 0.5 inch (about 12.7 mm) apart. An exit orifice 112 (also called an extrusion orifice) was drilled in the shoulder portion and extended toward the threaded portion a distance of 0.087 inch (about 2.2 mm). The diameter of the extrusion orifice was 0.0145 inch (about 0.37 mm). The extrusion orifice terminated within the die tip at a vestibular portion 142 having a diameter of 0.125 inch (about 3.2 mm) and a conical frustrum portion 144 which joined the vestibular portion with the extrusion orifice. The wall of the conical frustrum portion was at an angle of 30° from the vertical. The vestibular portion extended from the extrusion orifice to the end of the threaded portion of the die tip, thereby connecting the chamber defined by the die housing with the extrusion orifice.

The means for applying ultrasonic energy was a cylindrical ultrasonic horn 116. The horn was machined to resonate at a frequency of 20 kHz. The horn had a length of 5.198 inches (about 132.0 mm), which was equal to one-half of the resonating wavelength, and a diameter of 0.75 inch (about 19.0 mm). The face 146 of the first end 118 of the horn was drilled and tapped for a ⅜-inch (about 9.5-mm) stud (not shown). The horn was machined with a collar 148 at the nodal point 122. The collar was 0.094-inch (about 2.4-mm) wide and extended outwardly from the cylindrical surface of the horn 0.062 inch (about 1.6 mm). Thus, the diameter of the horn at the collar was 0.875 inch (about 22.2 mm). The second end 120 of the horn terminated in a small cylindrical tip 150 0.125 inch (about 3.2 mm) long and 0.125 inch (about 3.2 mm) in diameter. Such tip was separated from the cylindrical body of the horn by a parabolic frustrum portion 152 approximately 0.5 inch (about 13 mm) in length. That is, the curve of this frustrum portion as seen in cross-section was parabolic in shape. The face of the small cylindrical tip was normal to the cylindrical wall of the horn and was located about 0.4 inch (about 10 mm) from the extrusion orifice. Thus, the face of the tip of the horn, i.e., the second end of the horn, was located immediately above the vestibular opening in the threaded end of the die tip.

The first end 108 of the die housing was sealed by a threaded cap 154 which also served to hold the ultrasonic horn in place. The threads extended upwardly toward the top of the cap a distance of 0.312 inch (about 7.9 mm). The outside diameter of the cap was 2.00 inches (about 50.8 mm) and the length or thickness of the cap was 0.531 inch (about 13.5 mm). The opening in the cap was sized to accommodate the horn; that is, the opening had a diameter of 0.75 inch (about 19.0 mm). The edge of the opening in the cap was a chamfer 156 which was the mirror image of the chamfer at the second end of the die housing. The thickness of the cap at the chamfer was 0.125 inch (about 3.2 mm), which left a space between the end of the threads and the bottom of the chamfer of 0.094 inch (about 2.4 mm), which space was the same as the length of the collar on the horn. The diameter of such space was 1.104 inch (about 28.0 mm). The top 158 of the cap had drilled in it four ¼-inch diameter×¼-inch deep holes (not shown) at 90° intervals to accommodate a pin spanner. Thus, the collar of the horn was compressed between the two chamfers upon tightening the cap, thereby sealing the chamber defined by the die housing.

A Branson elongated aluminum waveguide having an input:output mechanical excitation ratio of 1:1.5 was coupled to the ultrasonic horn by means of a ⅜-inch (about 9.5-mm) stud. To the elongated waveguide was coupled a piezoelectric transducer, a Branson Model 502 Converter, which was powered by a Branson Model 1120 Power Supply operating at 20 kHz (Branson Sonic Power Company, Danbury, Conn.). Power consumption was monitored with a Branson Model A410A Wattmeter.

Example 1

This example illustrates the present invention as it relates to the emulsification of a molten thermoplastic polymer and water. A Grid Melter, Model GM-25-1 hydraulic pump system, obtained from J&M Laboratories Inc. of Dawsonville, Ga. was used to pump the molten polymer through the extrusion apparatus. The device has the capability to process up to 25 pounds of polymer per hour (about 11 kilograms per hour), and has an integral variable speed gear pump with a displacement of 1.752 cc/revolution. Temperature of the melt is regulated in two zones, premelt and main melt. Pressure is limited and regulated by an internal variable by-pass valve, and indicated by digital readout resolved to increments of 10 psi. Pump drive speed is controlled by a panel mounted potentiometer.

The Grid Melter was used to melt and pressurize a thermoplastic polymer. The polymer used was Himont HH-441 (Himont HH-441, Himont Company, Wilmington, Del.), a polypropylene having no melt processing additives and a melt flow rate of 400 grams per 10 minutes, or g/10 min. The melt flow rate is expressed in units of mass divided by time (i.e., grams/10 minutes). The melt flow rate was determined by measuring the mass of molten thermoplastic polymer under a 2.160 kg load that flowed through an orifice diameter of 2.0995±0.0051 mm during a specified time period such as, for example, 10 minutes at a specified temperature such as, for example, 180° C. as determined in accordance with ASTM Test Method D1238-82, "Standard Test Method for Flow Rates of Thermoplastic By Extrusion Plastometer," using a Model VE 4-78 Extrusion Plastometer (Tinius Olsen Testing Machine Co., Willow Grove, Pa.).

The Grid Melter pump drive speed was arbitrarily set at approximately 30 percent of the potentiometer range, and pressure was set and controlled by adjusting the by-pass valve. A 9-inch (about 23-cm) length of ¼-inch (about 6.4-mm) diameter stainless steel tubing was attached from the outlet of the Grid Melter to the inlet of the die housing.

The tubing and the extrusion cup were wrapped with heat tape as two zones, and the two zones were set and controlled by automatic heat controllers. The heat zones in both the grid melter and the extrusion apparatus were set to 340° F. and allowed to stabilize.

Water was injected into the molten polymer upstream of the ultrasonic apparatus (i.e., before the polymer and water entered the ultrasonic apparatus) utilizing a High Pressure Injector Pump; 90 V DC parallel shaft drive gear motor from W. W. Grainger, Inc., Alpharetta, Ga., speed range of 0–21 rpm; Dayton DC Speed Controller Model 6X165 from W. W. Grainger, Inc., Alpharetta, Ga. A 9/16" piston was used to inject water into the polymer stream.

Before the emulsification could be performed, the flow rate of the water was determined at different injector pump speeds. These flow rates were measured in units of grams per minute by weighing the amount of water exiting the piping for a one minute interval. The results are reported in Table 1.

TABLE 1

| Injector Pump Piston diameter - 9/16 inch | |
|---|---|
| Pump Speed Setting (Water) | Flow (g/min) |
| 20 | 0.08 |
| 30 | 0.19 |
| 40 | 0.33 |
| 50 | 0.49 |
| 60 | 0.67 |
| 70 | 0.82 |
| 80 | 0.98 |
| 90 | 1.17 |
| 100 | 1.19 |

The high pressure side stream injector pump was fitted with the 9/16 inch diameter piston and was filled with distilled water.

Pressure of the Grid Melter was adjusted to 250 psi and polymer was extruded at a rate of about 2 g/min through the exit orifice of the extruder apparatus. The water injection pump was started at a pump speed of slightly greater than 20 to add water to the molten thermoplastic polymer at a rate of 0.11 cc/min..

Once water began extruding with the molten polymer, ultrasonic energy was applied at a 30% of available power, drawing approximately 60 watts. The thread line was continuous and steady, and appeared a little foamy. A quantity of the strand or fiber was wound on a 6 inch diameter drum rotating at a speed that just kept the thread line taut from the die to the drum winder. The melt temperatures were reduced to 330° F. and the pressure increased to 390 psi.

Figure 2:
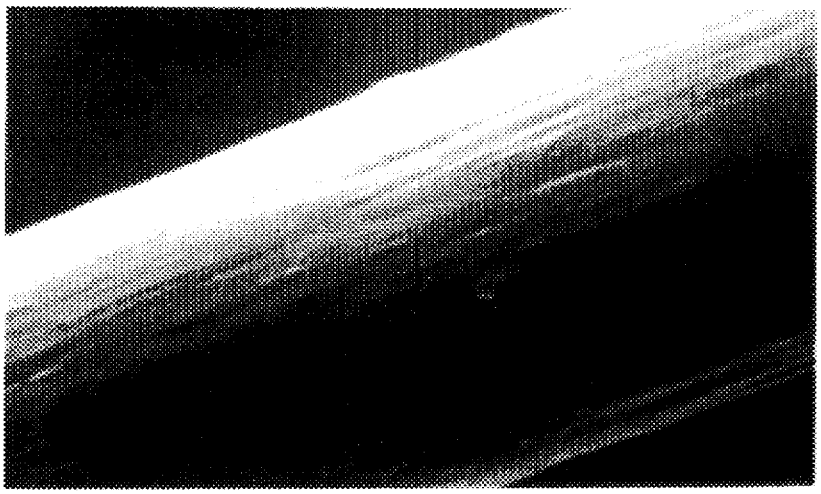
FIG. 2 is a photomicrograph of a strand made according to an embodiment of this invention with fissures in the surface of the strand.
Figure 3:
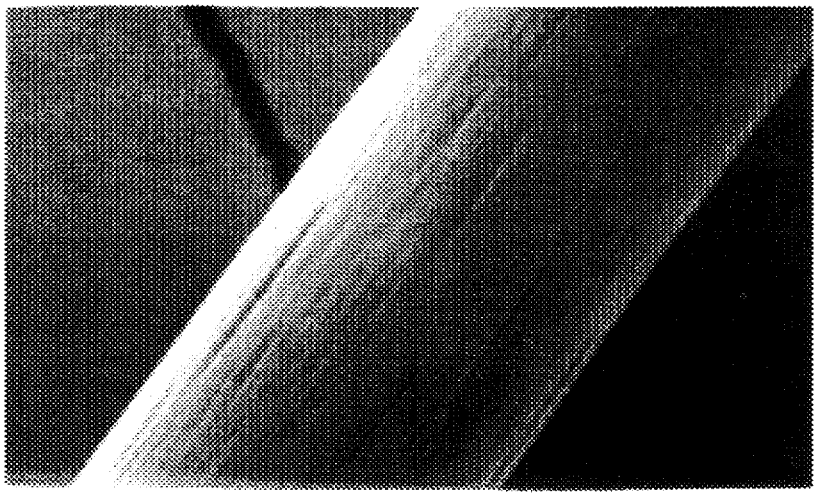
FIG. 3 is a photomicrograph of another strand made according to an embodiment of this invention with a plurality of fissures in the surface of the strand.

The fibers wound on the drum were cold drawn by hand to about 7–10 times their original length. The cold drawn fibers were examined by scanning electron microscopy. FIG. 2 is a photomicrograph (800× linear magnification) of the fiber produced at an extrusion temperature of 340° F. and a pressure of 250 psi. FIG. 3 is a photomicrograph (503× linear magnification) of the fiber produced at an extrusion temperature of 330° F. and a pressure of 390 psi. FIGS. 2 and 3 were made with a Cambridge Stereoscan 200 scanning electron microscope (SEM) and show that the fibers are covered with elongate fissures that are formed from ruptured steam bubbles near the surface of the fiber. The number of fissures in the strands range from about $1\times10^8$ to about $1\times10^{10}$ fissures per $m^2$ and is determined by visually counting the fissures in a square area of the strand surface using a scanning electron microscope.

To further characterize the effect of the ultrasonic emulsion on the polymeric strand produced in Example 1, a quantity (1 gram) of the drum wound strand of Example 1 formed at 340° F. and 250 psi was hand-drawn, and 15 random measurements of diameter were taken, the mean diameter being 75.1 micrometers. This sample is referred to as Sample 1. A 1 gram quantity of the same strand, undrawn, was likewise measured for diameter, the mean diameter being 211.5 micrometers. This sample is referred to as Sample 2. Both Sample 1 and Sample 2 were analyzed for surface area by using the B.E.T. krypton adsorbate method in accordance with ASTM D4780-88. The surface area was measured by Micromeritics® of Norcross, Ga. The B.E.T. surface area of Sample 1 was 0.1518 $m^2/g$. The surface area of a solid polypropylene fiber having a density of 0.9, and the same diameter as Sample 1 was 0.05918 $m^2/g$. The B.E.T. surface area of Sample 2 was 0.1233 $m^2/g$. The surface area of a solid polypropylene strand having a density of 0.9, and the same diameter as Sample 2 was 0.0210 $m^2/g$.

Example 2

A polymeric strand was made in accordance with the procedure of Example 1 except that the grid melter and piping temperature was 370° F. and the extrusion apparatus temperature was 380° F., the water was replaced with a solution of water and 20% polyvinyl alcohol (No. 125, Lot No. 04031512 available from Air Products and Chemicals, Inc. of Allentown, Pa.), the pressure of the grid melter was adjusted to 500 psi, the polymer flow rate, with the ultrasonic power setting at 30% and drawing about 50 watts, was 1.8 to 2.0 grams per minute, and the water injection pump was started at a setting of 20. The onset of the polyvinyl alcohol solution in the polymer extrudate was indicated by a change in the opacity of the extruded strand from translucent to milky white.

Figure 4:
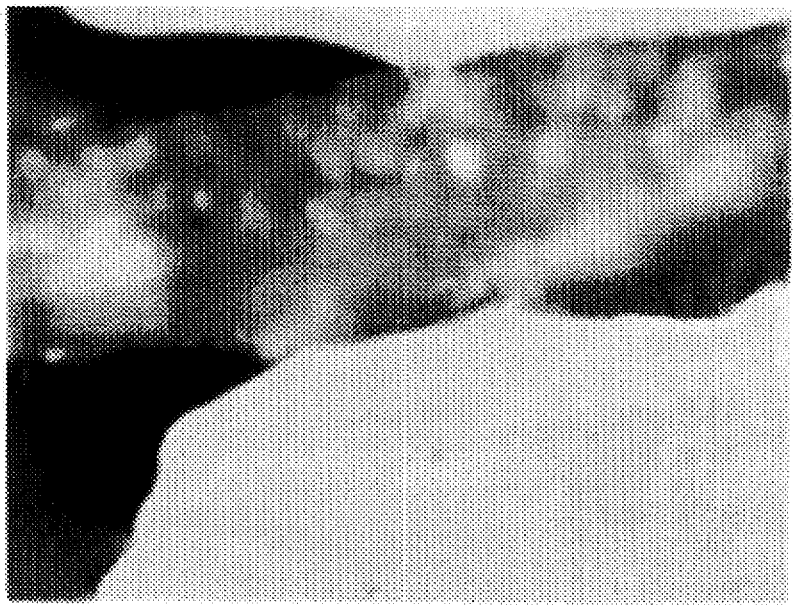
FIG. 4 is a photomicrograph of an undrawn strand made according to an embodiment of this invention. The strand has been insulted on the left side with tap water.
Figure 5:
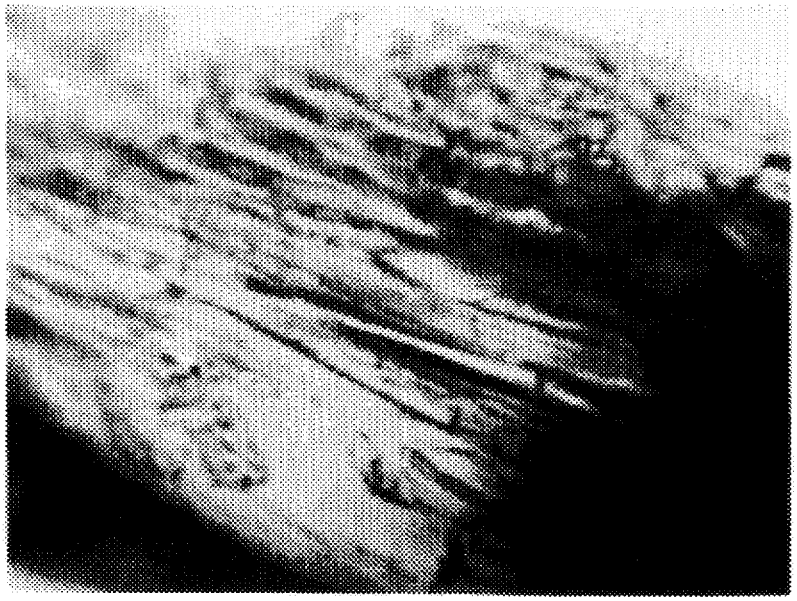
FIG. 5 is a photomicrograph showing the severed end of a slightly drawn strand made according to an embodiment of this invention and having a plurality of fissures on its surface. The strand has been insulted on the right end with tap water.
Figure 6:
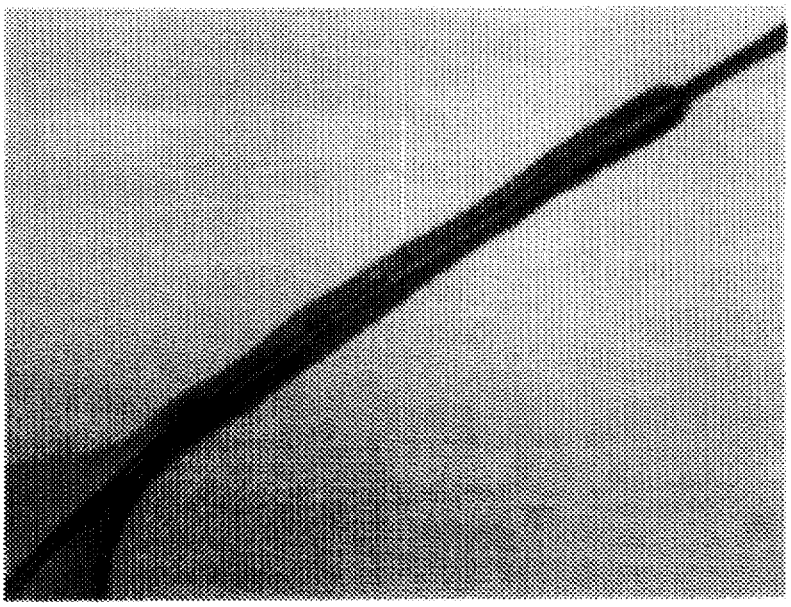
FIG. 6 is a photomicrograph of an air drawn strand made according to an embodiment of this invention with the insult water wicking left to right.

Samples were taken from the undrawn strand made in accordance with this Example 2, and were drawn using a hand-held air flow amplifier. FIG. 4 is a photomicrograph (51× linear magnification) of the undrawn strand from Example 2 having been insulted on the left side with tap water. FIG. 5 is a photomicrograph (51× linear magnification) showing a severed end of a slightly drawn strand from Example 2. The striations from lower right to upper left are the elongated microbubbles formed by the water component flashing in the seam. The sample was insulted at the lower right with tap water. The short lines that are approximately normal to the long striations are the fronts of water streams as they wicked through the strand from right to left. FIG. 6 is photomicrograph (128× linear magnification) showing an air drawn strand from Example 2 with the insult water wicking from left to right. FIGS. 4–6 were made with an Olympus BH-2 stereo microscope coupled to a Hitachi VK-C350 video camera.

The method of this invention permits the formation of extruded products with constituent materials and properties different from those produced by conventional extrusion methods. In addition, the method of this invention accommodates the addition of amendments currently used in normal extrusions methods. A significant advantage to the method of this invention is that the amendments or immiscible components are added at the point of extrusion, and are not a consideration in upstream portions of the processes such as blending, feeding, melting, pressurizing, filtering, and metering.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

I claim:

1. A melt-extruded polymeric strand comprising a melt-extrudable polymer and having a surface and a plurality of fissures in the surface such that the strand has a B.E.T. surface area within a range from about 0.10 to about 0.18/g.

2. A melt-extruded polymeric strand as in claim 1 wherein the strand has a mean diameter within the range from about 1 to about 200 micrometers.

3. A melt-extruded polymeric strand as in claim 1 wherein the fissures are present in an amount from about $1\times10^8$ to about $1\times10^{10}$ per $m^2$.

4. A melt-extruded polymeric strand as in claim 3 wherein the strand has a mean diameter within the range from about 1 to about 200 micrometers.

5. A melt-extruded polymeric strand as in claim 1 wherein the fissures are formed during melt-extrusion of the strand by expanding gas which initially is entrapped in the melt-extrudable polymer during melt-extrusion and then explodes through the surface of the strand.

6. A melt-extruded polymeric strand as in claim 1 wherein the strand has a length, the melt-extrudable polymer is continuous along the length of the strand, and the strand further comprises an immiscible component which is immiscible with the melt-extrudable polymer when the melt-extrudable polymer and the immiscible component are at a temperature suitable for melt-extrusion of the melt-extrudable component, the immiscible component being present at the surface of the strand at the fissures.

7. A melt-extruded polymeric strand as in claim 6 wherein the immiscible component performs a function at the surface of the strand not performed by the melt-extrudable polymer.

8. A melt-extruded polymeric strand as in claim 6 wherein the melt-extrudable polymer is hydrophobic and the immiscible component comprises a hydrophilic polymer.

9. A melt-extruded polymeric strand as in claim 8 wherein the immiscible component comprises polyvinyl alcohol.

10. A melt-extruded polymeric strand as in claim 6 wherein the immiscible component is a surfactant.

11. A melt-extruded polymeric strand as in claim 6 wherein the immiscible component is an odorant.

12. A melt-extruded polymeric strand as in claim 6 wherein the immiscible component is a starch.

13. A melt-extruded polymeric strand as in claim 1 wherein the strand is a fiber.

14. A melt-extruded polymeric strand as in claim 1 wherein the strand is a filament.

15. A melt-extruded polymeric strand as in claim 1 wherein the melt-extrudable polymer is a thermoplastic polymer.

16. A melt-extrudable polymeric strand as in claim 1 wherein the B.E.T. surface area of the strand is 2 to 6 times the B.E.T. surface area of an otherwise identical strand lacking the plurality of fissures.

17. A melt-extruded polymeric strand comprising a melt-extrudable polymer and having a surface and a plurality of fissures in the surface such that the strand has a B.E.T. surface area which is 2 to 6 times the B.E.T. surface area of an otherwise identical strand lacking the plurality of fissures.

18. A melt-extruded polymeric strand comprising a continuous phase and a disperse phase, the continuous phase comprising a melt-extrudable polymer and the disperse phase comprising a fluid which is immiscible with the continuous phase when the continuous phase and disperse phase are at a temperature suitable for melt-extrusion of the polymeric strand.

19. A melt-extruded polymeric strand as in claim 18 wherein the disperse phase comprises discrete pockets of fluid separated by the continuous phase.

20. A melt-extruded polymeric strand as in claim 18 wherein the disperse phase comprises an oil.

21. A melt-extruded polymeric strand as in claim 18 wherein the disperse phase is a liquid selected from the group consisting of lubricating oils, skin emollients, tinting oils, waxes, polishing oils, silicones, vegetable oils, glycerines, lanolin, flame retardants, tackifiers, degredation triggers, insecticides, fungicides, bactericides, viricides, colloids, and suspensions.

22. A melt-extruded polymeric strand as in claim 18 wherein the disperse phase comprises a gas.

23. A melt-extruded polymeric strand as in claim 22 wherein the gas is air.

24. A melt-extruded polymeric strand as in claim 22 wherein the gas is an electroluminescent gas.

25. A nonwoven web comprising a plurality of the strands of claim 1.

26. A nonwoven web comprising a plurality of the strands of claim 18.

* * * * *